US005209711A

United States Patent [19]

Scrima

[11] Patent Number: 5,209,711

[45] Date of Patent: May 11, 1993

[54] LEG STRETCHING MACHINE

[76] Inventor: Nick Scrima, 4944 E. 111th St., Garfield Heights, Ohio 44125

[21] Appl. No.: 860,059

[22] Filed: Mar. 30, 1992

[51] Int. Cl.[5] ..... A63B 22/00

[52] U.S. Cl. ..... 482/70; 482/51

[58] Field of Search ..... 482/70, 72, 148, 907, 482/51

[56] References Cited

U.S. PATENT DOCUMENTS

| | | | |
|---|---|---|---|
| 3,540,724 | 11/1970 | Hunter | 482/148 |
| 4,402,506 | 9/1983 | Jones | 482/70 |
| 4,468,025 | 8/1984 | Sferle | 482/72 |
| 4,506,884 | 3/1985 | Hankin | 482/907 |

FOREIGN PATENT DOCUMENTS

| | | | |
|---|---|---|---|
| 2120110 | 11/1983 | United Kingdom | 482/130 |

*Primary Examiner*—Stephen R. Crow

*Attorney, Agent, or Firm*—Richard A. Romanchik

[57] ABSTRACT

A stretching machine includes a center stand having horizontal bars, vertical stand bars and cross bars for providing a support for a person to hold onto. A pair of movable foot supports include brackets with rollers that translate along a pair of elevated translation bars which extend outward from the center stand to allow the person to easily extend his/her feet away from the center stand.

7 Claims, 3 Drawing Sheets

LEG STRETCHING MACHINE

TECHNICAL

This invention relates to exercise machines, and more particularly to a machine for improving stretching flexibility.

BACKGROUND ART

Engaging in athletic activities usually takes more muscular flexibility than non-athletic activities. One of the most difficult and time consuming aspects of engaging in athletic activity is obtaining proper and adequate flexibility through stretching conditioning. Indeed, it is typical for an athlete to spend much more time preparing for athletic competition in the form of stretching exercises than the athlete spends in competition, for failure to prepare oneself with adequate flexibility and stretching exercises can lead to serious injury.

The leg muscles in particular are critical to most forms of athletic activity. These muscles are the largest muscle group of the body and are perhaps the most susceptible to injury due to improper stretching and flexibility preparation. To complicate matters it is difficult to adequately perform stretching exercises with the legs in an upright position because the contact between the feet and the ground impair the maneuverability of the feet to extend outwards from the vertical axis of the body. Yet is highly desirable to condition the leg muscles to be able to extend fully out away from the body while the torso rests on the ground. This maneuver is traditionally called the "splits". Being able to comfortably due the splits is an indication that an athlete has maximum flexibility in his legs, thus minimizing the chances of muscular injuries in athletic competition. Because of the above mentioned problem, it is difficult for athletes to be able to condition themselves to do splits comfortably.

A machine which facilitates an athlete in conditioning himself or herself to obtain maximum flexibility in the legs is therefore highly desirable.

DISCLOSURE OF THE INVENTION

An object of the present invention is to provide a machine which facilitates stretching and flexibility conditioning of the legs.

According to the present invention, a leg stretching machine includes a center stand having a pair of foot rests which are movably secured to a pair of translation bars which extend outwardly from the center stand. The foot rests translate on the translation bars perpendicularly away from the center stand. A person places his feet on the foot rests with his torso centered in the center stand. The center stand has at least two sets of cross bars for a person to grasp onto while engaging in stretching exercises.

The present invention is easy to use and offers maximum stretching and flexibility conditioning attributes. The suspended translation allows the footrests to slide smoothly on most any surface, allowing usage of the present invention both outdoors and indoors. It is also inexpensive to manufacture, lightweight, and easily disassembled for convenient storage.

These and other objects, features, and advantages of the present invention will become more apparent in light of the detailed description of exemplary embodiments thereof, as illustrated by the drawings.

BEST MODE FOR CARRYING OUT THE INVENTION

Figure 1:
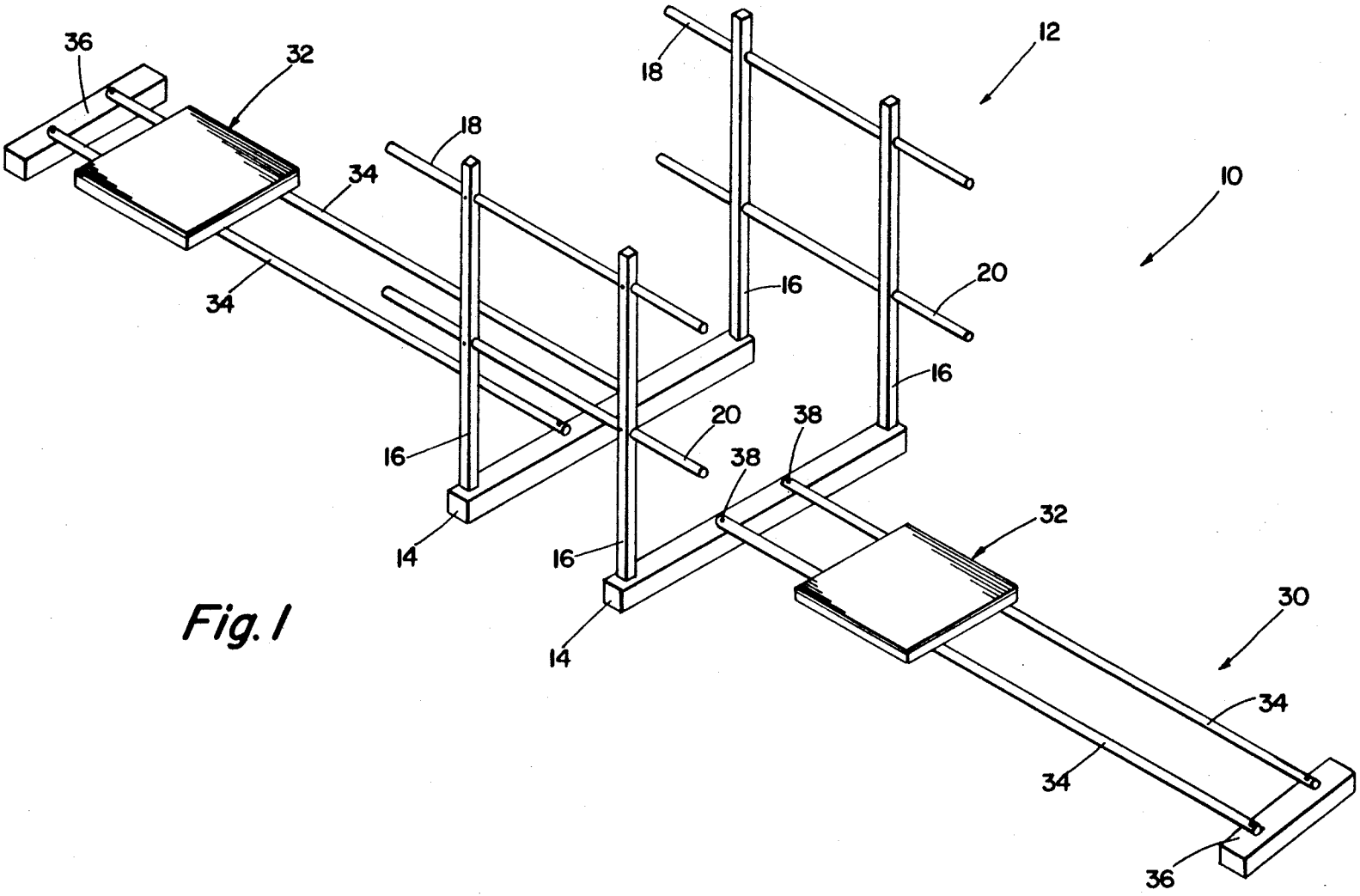
FIG. 1 is an isometric view of a stretching machine in accordance with the present invention.

Referring now to FIG. 1, a stretching machine 10 includes a center stand 12 having a pair of essentially parallel horizontal brace bars 14, and four vertical stand bars 16 extending vertically upward from the ends of the horizontal brace bars. Four cross bars extend across the vertical stand bars 16, with a pair of high cross bars 18 and a pair of low cross bars 20 going across both pairs of vertical stand bars 16 attached at common ends of the horizontal brace bars 14. Each vertical stand bar 16 therefore has two cross bars 18, 20 extending therethrough. The vertical stand bars 16 are detachably connected to the ends of the horizontal brace bars 14. The preferred way for the vertical stand bars 16 to connect with the horizontal brace bars 14 is to provide holes (not shown) in the ends of the horizontal brace bars 14 to accept the vertical stand bars 16 so that the vertical stand bars 16 may be removed upon disassembly of the stretching machine 10. It is preferred that the horizontal brace bars 14 and the vertical stand bars 16 have an approximate square cross-section and the cross bars 18, 20 have an approximate circular cross section. It is also preferable to have the cross bars 18, 20 slidably engage through the vertical stand bars 14 by having circular holes (not shown) provided through the vertical stand bars 14 so that they may also be removed upon disassembly of the machine 10. Under these conditions the center stand 12 can be easily disassembled for convenient storage.

A pair of foot translation assemblies 30 extend outward approximately perpendicularly from the approximate center of each horizontal brace bar 14. Each foot translation assembly 30 includes a foot rest assembly 32, a pair of translation bars 34, and an end brace bar 36. Each foot rest assembly 32 slidably engages with a pair of translation bars 34 to allow each foot rest assembly 32 to move or translate approximately perpendicularly to the horizontal brace bars 14. Each translation bar 34 is permanently attached to its respective end brace bar 36, and fixably attached to its respective horizontal brace bar 14 by a detachable means, such as by a pin 38 or bolt (not shown) which extends through each translation bar 34 into the horizontal brace bar 14 so that they may be removed easily. The stretching machine 10 can thus be easily disassembled for convenient storage and shipping by separating the foot translation assemblies 30 and vertical stand bars 16 from their respective horizontal brace bar 14. Of course, other methods well known in the art may be utilized to attach the translation bars 34 to the horizontal brace bars 14. It is to be noted that the height of end brace bar 36 should be approximately the same height as the horizontal brace bar 14 so that the translation bars 34 extend outward horizontally above the ground and approximately parallel to the ground. This permits a person to use the present invention on most any surface, including dirt, grass, pavement, and carpeting. It is also to be noted that the foot translation assemblies 30 should extend outward from the center stand 12 approximately 180 degrees apart.

Operation of the stretching machine 10 in accordance with the present invention is as follows. A person stands in the approximate center of the center stand 12 and places one foot on each foot rest assembly 32. A person then engages in stretching his leg muscles by holding on to one or more of the cross bars 18, 20 and extending his legs outward and inward on the foot rest assembly 32 as needed. The foot rest assemblies 32 are constructed to slide or translate easily along the translation bars 34. Heretofore, a person had to slide his/her feet along the ground in order to accomplish this motion. The moveable foot rest assemblies 32, suspended on the translation bars 34, make this motion much easier and therefore allow a person to do stretching exercises with more ease and convenience. During the early stages of a person's conditioning program, the person will be unable to obtain maximum extension of his legs outward from the center. The person will therefore most likely only utilize the top cross bars 18 when performing stretching exercises. As that person's legs become more flexible, that person will be able to extend his feet further outward thus enabling his torso to get closer to the ground. As the person becomes able to get close to the ground, he/she will most likely utilize the lower cross bars 20 for maintaining stability. The lower cross bars 20 are particularly advantageous because when a person has his legs at maximum extension (i.e. the foot rest assemblies 32 are at their maximum distance from the horizontal bars 14), the person has minimal strength from his legs to lift his/her torso back up to the upright standing position. The lower cross bars 20 give a person something to hold onto under these conditions in order to help himself/herself up to an upright position by utilizing upper body muscles. The upper cross bar 18/lower cross bar 20 combination facilitates a person to lower himself/herself gradually while gradually extending the legs outward to a full down position and then gradually lift himself/herself up to an upright position by lifting or by holding on to the cross bars 18, 20 in consecutive steps.

Figure 2:
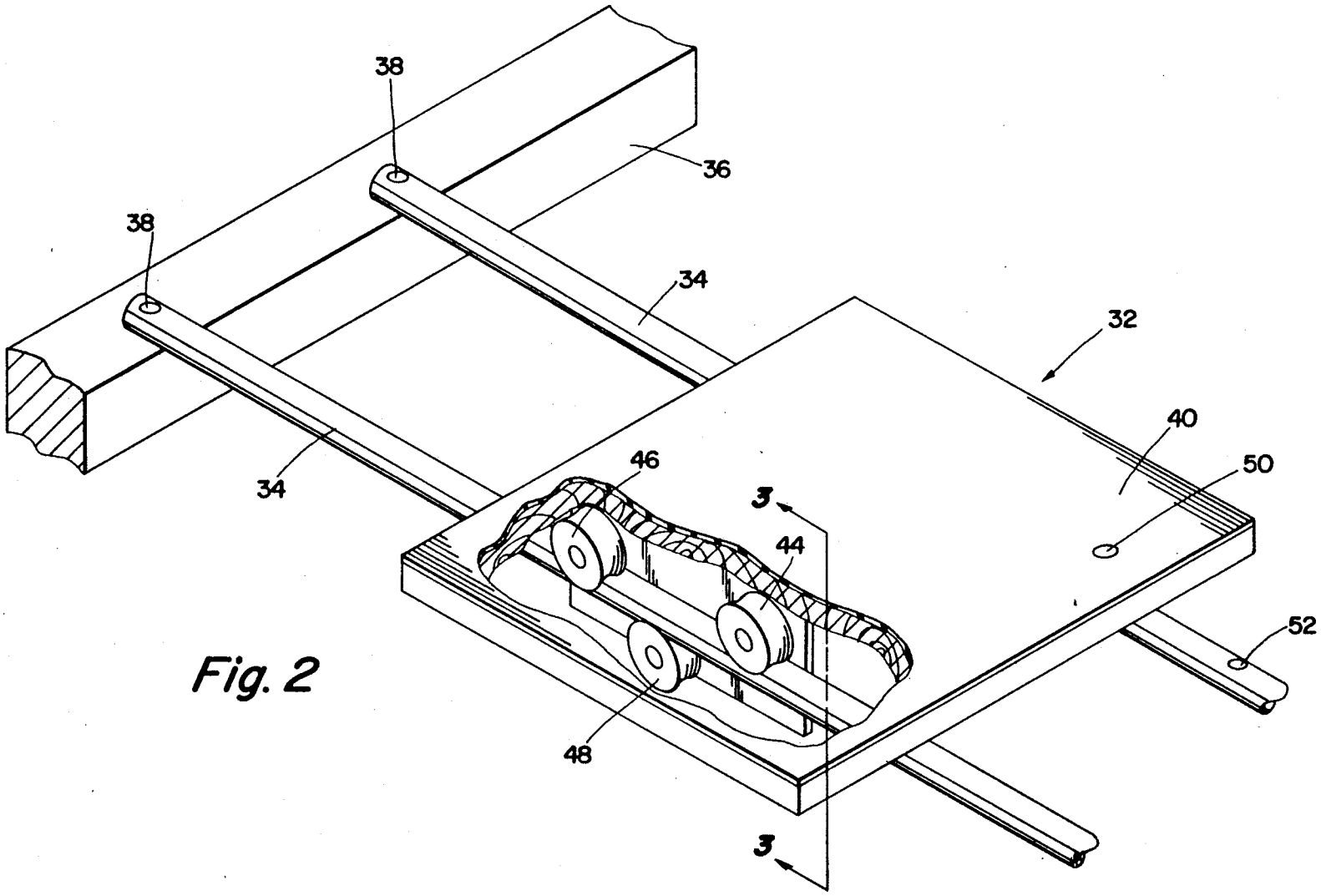
FIG. 2 is an isometric view partly cut away, of a foot rest for a stretching machine in accordance with the present invention.

Referring now to FIG. 2, each foot rest assembly 32 includes a foot pad 40 for placing a foot thereon. The foot pad 40 may be made of any of a number of materials, such as a wood/rubber composite, well known in the art to provide a stable, non-slip surface for supporting a person's foot. A pair of guide roller assemblies 41 (one of which is not shown) each include a guide roller brace 42 which extends downward from the bottom of the foot pad 40 and is attached thereto. Each guide roller brace 42 has three guide rollers 44, 46, 48 connected thereto for engagement with the translation bars 34. Two guide rollers 44, 46 are positioned to roll on top of the brace bar 34 to support the weight of a person and allow easy translation of the foot rest assembly 32 along the translation bars 34. The third guide roller 48 connected to each guide roller brace 42 is positioned to roll along the bottom of each brace bar 34 and therefore prevent the foot rest assembly 32 from coming off of the translation bars 34. The guide rollers 44–48 may be comprised of any of a number of materials, such as rubber, which facilitate easy rolling along the translation bars 34. It is preferred that the guide rollers 44–48 have roller bearing assemblies (not shown) in order to minimize resistance to rolling. Each foot rest 40 also has a hole 50 disposed therethrough for alignment with at least one hole 52 disposed through a respective translation bar 34. When the holes are aligned, a pin (not shown) can be placed through both holes 50, 52 in order to prevent the foot rest assembly 32 from moving. In this manner a person can lock one foot rest in position in order to provide extension of only one leg at a time. A plurality of holes identical to hole 52 may be provided in a number of places along translation bar 34 to allow the foot rest assembly 32 to be locked in more than one location. It is to be noted that other mechanisms (not shown herein) well known to those skilled in the art may be utilized to provide this locking feature.

Figure 3:
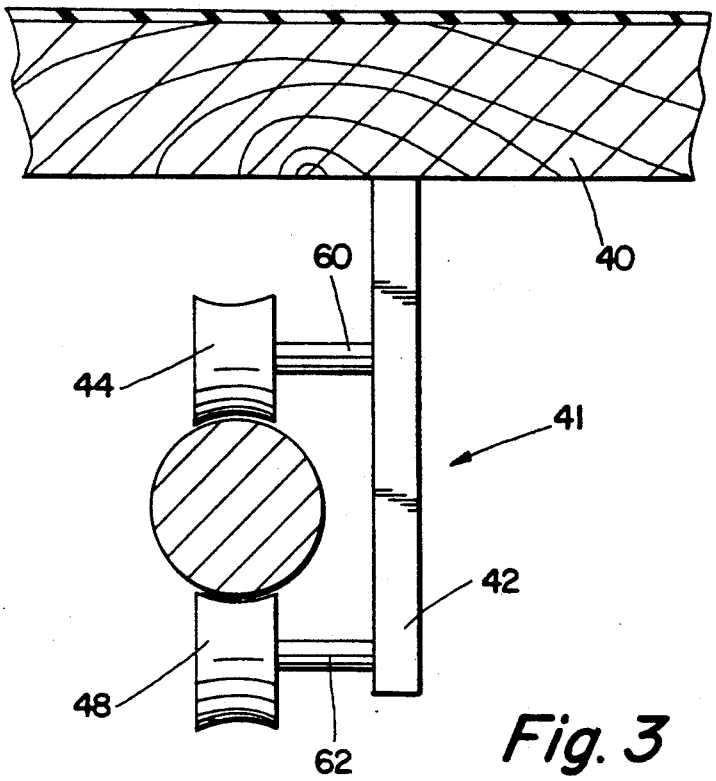
FIG. 3 is an end view of a first embodiment of a roller assembly for a foot rest of a stretching machine in accordance with the present invention.

Referring now to FIG. 3, a first embodiment of each guide roller assembly 41 includes a guide roller brace 42 which is attached to the bottom of the foot rest 40 and descends vertically downward therefrom. Guide rollers 44, 48 and 46 (not shown) are connected to the guide roller brace 42 utilizing connecting rods or axles 60, 62. Guide rollers 44, 48 roll along translation bar 34. Guide rollers 44 and 46 (not shown) bear the weight of the individual and roll on top of the translation bar 34. Guide roller 48 prevents the foot rest assembly 32 from lifting off of the translation bar 34. Each foot rest assembly 32 has two guide assemblies 41 attached thereto and extending downwardly therefrom, one for each translation bar 34. It is to be noted that a second guide roller brace (not shown) may be included with each guide roller assembly 41. Under this condition, the second guide roller brace (not shown) would be positioned on the opposite side of the guide rollers 44–48 and may be utilized to provide additional support. If a second guide roller brace (not shown) is utilized, then connecting rods 60, 62 would extend through the guide rollers 44–48 and be connected to the second guide roller brace (not shown) in the same manner as the connecting rods 60, 62 are connected to guide roller brace 42. An embodiment of a guide roller assembly having two guide roller braces will be shown and described in greater detail hereinafter.

Figure 4:
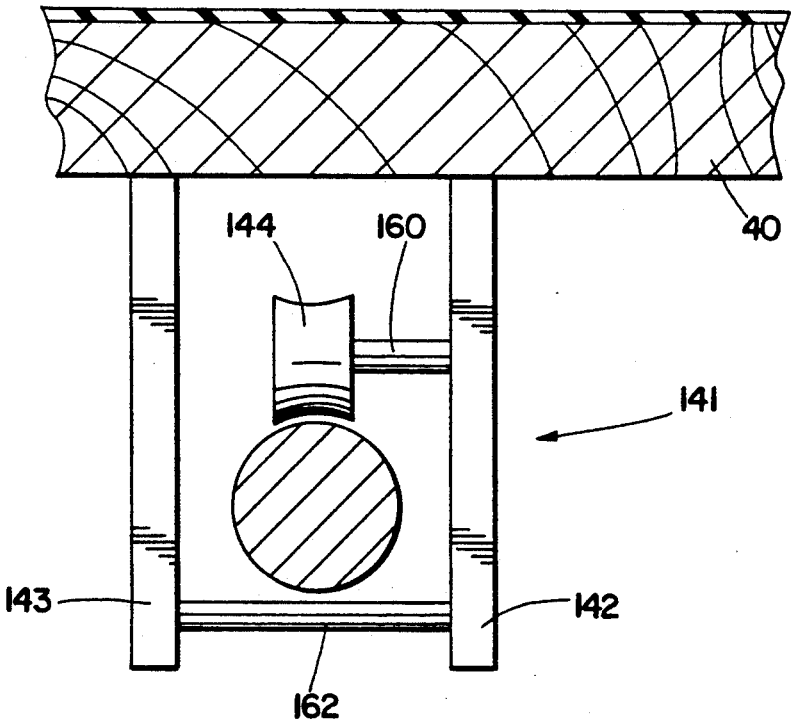
FIG. 4 is an end view of a second embodiment of a roller assembly for a foot rest of a stretching machine in accordance with the present invention.

Referring now to FIG. 4, a second embodiment of a guide roller assembly 141 includes a pair of guide roller braces 142, 143 which are attached to the bottom of foot rest 40. A bearing or connecting rod 162 is connected between guide roller braces 142, 143 below translation bar 34. Guide roller 144 is rotatably disposed on an upper connecting rod 160. A second guide roller (not shown) is disposed on a second connecting rod (not shown) behind guide roller 144. Guide roller 144 and the second guide roller roll on top of translation bar 34 and bear the weight of the person standing on foot rest 40. Bearing or connecting rod 162 prevents foot rest 40 from coming off translation bar 34.

Although the invention has been shown and described with exemplary embodiments thereof, it should be understood by those skilled in the art that the foregoing and various other changes, omissions, and additions may be made therein and thereto without departing from the spirit and the scope of the invention.

I claim:

1. An apparatus for stretching the muscles of a person having a first and second foot, comprising:

center stand means, having horizontal base means for resting on the ground, and vertical extension means attached to said horizontal base means extending upwards approximately vertically therefrom;

first foot translation bar means attached to said horizontal base means and extending horizontally therefrom in a first direction approximately parallel to the ground;

first foot support means disposed on said first foot translation bar means for supporting the first foot, wherein said first foot support means translates on said first foot translation bar means for permitting the first foot to be extended away from said center stand means;

second foot translation bar means attached to said horizontal base means and extending horizontally therefrom approximately parallel to the ground in a direction approximately 180 degrees from said first direction;

second foot support means disposed on said second foot translation bar means for supporting the second foot, wherein said second foot support means translates on said second foot translation bar means for permitting the second foot to be extended away from said center stand means;

crossbar means attached to said vertical extension means for providing a means for the person to hold, wherein the person holds onto said crossbar means and extends his/her feet away from his/her torso by moving either or both of his/her feet on said first and second foot support means along said first and second foot translation bar means, wherein said first and second foot translation bar means are comprised of two approximately parallel bars; and, wherein said first and second foot support means are comprising: a) foot pad means having a top for placing the foot thereon and a bottom; b) two bracket means attached to said bottom and extending below said foot pad means; c) two roller means connected to each of said two bracket mean and disposed on top of each of said two approximately parallel bars for rolling ons said approximately parallel bars; and, d) holding means attached to each of said two bracket means below each of said two approximately parallel bars for preventing said foot pad means from coming off of said foot translation bar means.

2. An apparatus for stretching the muscles of a person having a first and second foot, comprising:

center stand means, having horizontal base means for resting on the ground, and vertical extension means attached to said horizontal base means extending approximately vertically therefrom, said vertical extension means having four approximately vertical bars, with one of said approximately vertical bars disposed at each of said first and second ends;

said horizontal base means having first horizontal bar means for securing said first translation bar means and second horizontal bar means for securing said second translation bar means, said first and second horizontal bar means each having a first and second end;

first foot translation bar means attached to said horizontal base means and extending horizontally therefrom approximately parallel to the ground in a first direction, said first foot translation bar means being comprised of two approximately parallel bars;

first foot support means disposed on said first translation bar means for supporting the first foot, wherein said first foot support means translates on said first translation bar means for permitting the first foot to be extended away from said center stand means by translation on said first translation bar means;

second foot translation bar means attached to said horizontal base means and extending horizontally therefrom approximately parallel to the ground in a second direction approximately 180 degrees from said first direction, said second foot translation bar means being comprised of two approximately parallel bars;

second foot support means disposed on said second translation bar means for supporting the second foot, wherein said second foot support means translates on said second translation bar means for permitting the second foot to be extended away from said center stand means by translation on said second translation bar means;

said first and second foot support means having foot pad means having: a) a top for placing the foot thereon and a bottom; b) two bracket means attached to said bottom and extending below said bottom; c) two roller means connected to each of said two bracket means, for rolling on each of said two foot translation bar means; and d) bearing means connected to each of said two bracket means below each of said two translation bar means for preventing said first and second foot support means from coming off each of said two translation bar means; and, crossbar means attached to said vertical extension means for providing a means for the person to hold, said crossbar means having four approximately horizontal crossbars, with a first pair of said approximately horizontal crossbars being disposed across said approximately vertical bars which are disposed at said first end, and a second pair of said approximately horizontal bars being disposed across said approximately vertical bars which are disposed at said second end, wherein said approximately horizontal bars in said first and second pairs are disposed at different heights on said vertical extension means for providing a means for hand held support to the person at different levels of foot extension, wherein the person holds onto said crossbar means and extends his/her feet away from his/her torso by moving either or both of his/her feet on said first and second foot support means along said first and second translation means.

3. An apparatus according to claim 2, wherein said first and second foot support means are further comprised of locking means for locking said first and second foot support means in place on said first and second foot translation bar means.

4. An apparatus according to claim 2, wherein said crossbar means are detachable from said vertical extension means.

5. An apparatus according to claim 2, wherein said first and second foot translation bar means are detachable from said horizontal base means.

6. An apparatus according to claim 2, wherein said vertical extension means is detachable from said horizontal base means.

7. An apparats according to claim 2, wherein said first and second foot translation bar means have a first end attached to said horizontal base means and a second end, the apparatus further comprising:

a pair of end bar means attached to said second end of said first and second translation bar means, wherein said horizontal base means and said pair of end bar means support said first and second translation bar means above the ground.

* * * * *